US007088059B2

(12) United States Patent
McKinney et al.

(10) Patent No.: US 7,088,059 B2
(45) Date of Patent: Aug. 8, 2006

(54) MODULATED CONTROL CIRCUIT AND METHOD FOR CURRENT-LIMITED DIMMING AND COLOR MIXING OF DISPLAY AND ILLUMINATION SYSTEMS

(75) Inventors: Steven J. McKinney, Tamarac, FL (US); Matthew C. Polak, Independence, OH (US)

(73) Assignee: Boca Flasher, Boca Raton, FL (US)

( * ) Notice: Subject to any disclaimer, the term of this patent is extended or adjusted under 35 U.S.C. 154(b) by 36 days.

(21) Appl. No.: 10/896,321

(22) Filed: Jul. 21, 2004

(65) Prior Publication Data

US 2006/0017402 A1 Jan. 26, 2006

(51) Int. Cl.
*G05F 1/00* (2006.01)
*H05B 39/00* (2006.01)

(52) U.S. Cl. ..... 315/291; 315/294; 315/320

(58) Field of Classification Search ..... 315/291, 315/307, 294, 313, 316
See application file for complete search history.

(56) References Cited

U.S. PATENT DOCUMENTS

| | | | | |
|---|---|---|---|---|
| 4,870,325 | A | 9/1989 | Kazar | 315/178 |
| 5,008,595 | A | 4/1991 | Kazar | 315/178 |
| 6,016,038 | A | 1/2000 | Mueller | 315/291 |
| 6,150,772 | A * | 11/2000 | Crane | 315/291 |
| 6,150,774 | A | 11/2000 | Mueller | 315/291 |
| 6,510,995 | B1 | 1/2003 | Muthu | 235/454 |
| 6,618,031 | B1 | 9/2003 | Bohn | 345/83 |
| 6,836,079 | B1 * | 12/2004 | Hong | 315/291 |
| 2002/0014864 | A1 * | 2/2002 | Gemunder et al. | 315/291 |
| 2002/0101198 | A1 * | 8/2002 | Kemp | 315/291 |

OTHER PUBLICATIONS

Application Note 008. Frequency Modulation Techniques for the Control of LED Color Mixing and Intensity, at Appnote 009 from website www.artisticlicence.com Jun. 17, 2004.

* cited by examiner

*Primary Examiner*—Trinh Dinh
*Assistant Examiner*—Angela M Lie
(74) *Attorney, Agent, or Firm*—Valerie E. Looper; John J. Yim

(57) ABSTRACT

A control circuit for a lighting system allows analog control over a first range of illumination intensities in which the intensity of the illumination source varies in proportion to the voltage level of the control signal. The circuit provides for improved dimming and color mixing capability by allowing pulse width or frequency modulation control in addition to analog control over a second range of illumination intensities.

10 Claims, 7 Drawing Sheets

Fig. 1 Typical LED Intensity v. Forward Current
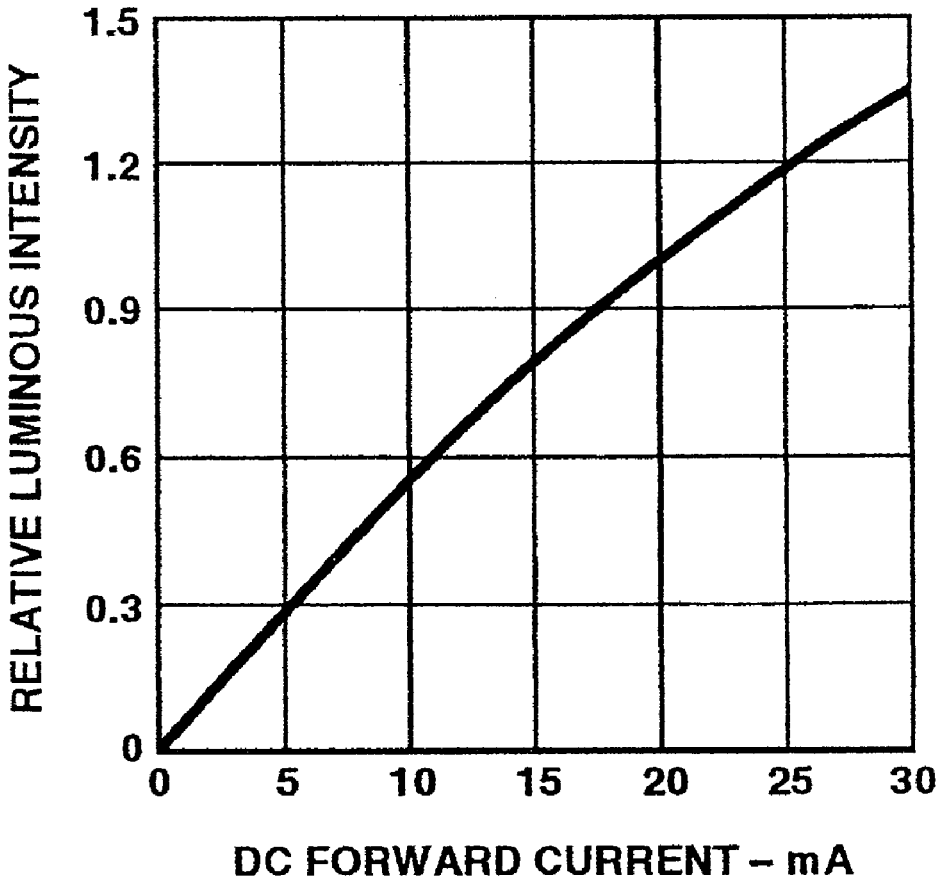

Fig. 2 Prior Art Analog Control LED Dimming Circuit
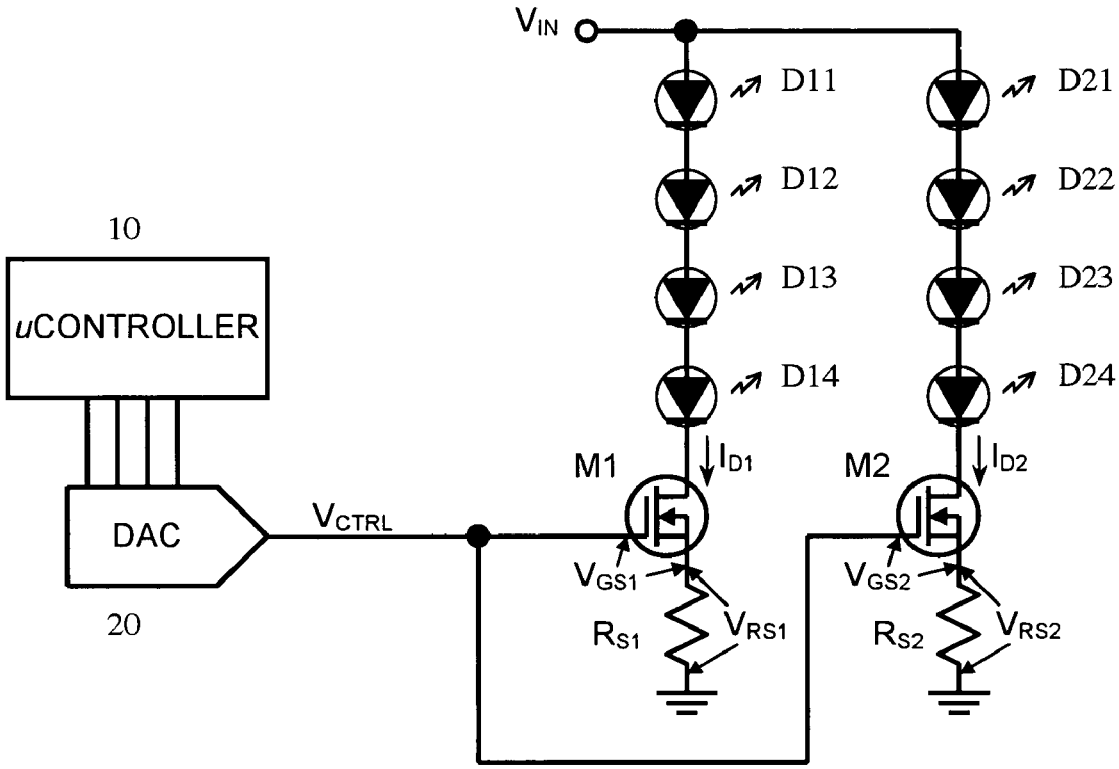

Fig. 3 Typical LED Wavelength Shift v. Forward Current
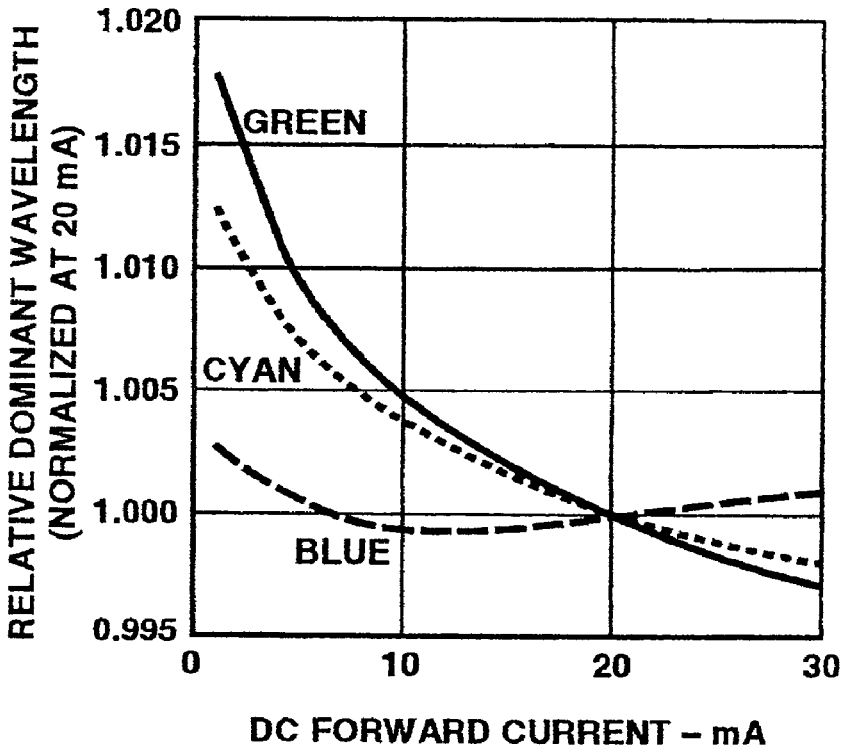

Fig. 4 Modulated Analog Control LED Dimming Circuit
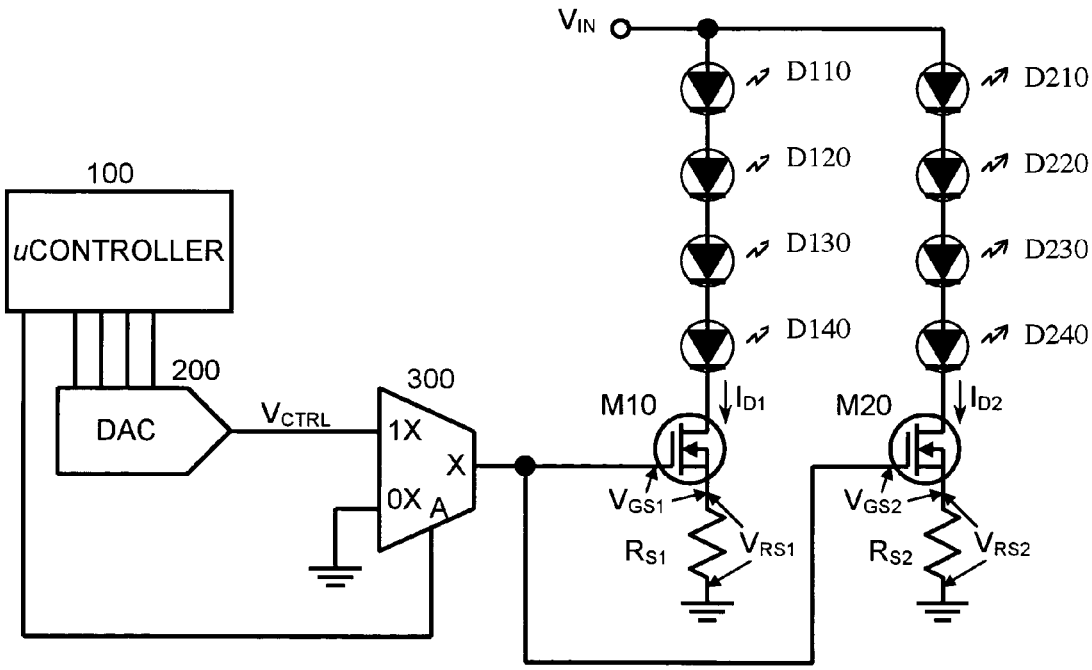

Fig. 5 Characteristic Values for Modulated Analog Control LED Dimming Circuit:

| LED Illumination (% of Full) | Analog Control $V_{CTRL}$ (Volts) | Instantaneous LED Current $I_D$ (mA) | Pulse Duration (us) | | Effective Duty Cycle | Resultant Frequency |
|---|---|---|---|---|---|---|
| | | | OFF | ON | | |
| 100% | 5.00 | 20 | 0 | Continually | 100% | N/A |
| 95% | 4.85 | 19 | 0 | Continually | 100% | N/A |
| 90% | 4.70 | 18 | 0 | Continually | 100% | N/A |
| 85% | 4.55 | 17 | 0 | Continually | 100% | N/A |
| 80% | 4.40 | 16 | 0 | Continually | 100% | N/A |
| 75% | 4.25 | 15 | 0 | Continually | 100% | N/A |
| 70% | 4.10 | 14 | 0 | Continually | 100% | N/A |
| 65% | 3.95 | 13 | 0 | Continually | 100% | N/A |
| 60% | 3.80 | 12 | 0 | Continually | 100% | N/A |
| 55% | 3.65 | 11 | 0 | Continually | 100% | N/A |
| 50% | 3.50 | 10 | 0 | Continually | 100% | N/A |
| 45% | 3.35 | 9 | 0 | Continually | 100% | N/A |
| 40% | 3.20 | 8 | 0 | Continually | 100% | N/A |
| 35% | 3.05 | 7 | 0 | Continually | 100% | N/A |
| 30% | 2.90 | 6 | 0 | Continually | 100% | N/A |
| 25% | 2.75 | 5 | 0 | Continually | 100% | N/A |
| 20% | 2.75 | 5 | 100 | 400 | 80% | 2000 |
| 15% | 2.75 | 5 | 100 | 150 | 60% | 4000 |
| 10% | 2.75 | 5 | 100 | 67 | 40% | 6000 |
| 5% | 2.75 | 5 | 100 | 25 | 20% | 8000 |
| 0% | 2.75 | 5 | Continually | 0 | 0% | N/A |

MODULATED CONTROL CIRCUIT AND METHOD FOR CURRENT-LIMITED DIMMING AND COLOR MIXING OF DISPLAY AND ILLUMINATION SYSTEMS

FIELD OF THE INVENTION

This invention relates to controllers for illumination devices such as LEDs (light emitting diodes). The use of LEDs in illumination systems is well known. These devices are especially useful for lighting components, systems, and finished goods. LED lighting is a fast growing segment of the lighting industry due to the efficiency, reliability and longevity of LEDs. Product usage applications include but are not limited to interior and exterior signage, cove lighting, architectural lighting, display case lighting, under water lighting, marine lighting, and many others. The present invention includes lighting controllers compatible with LED bulbs, color changing LED strips, color wash controllers, LED brick lights, LED color changing disks, LED traffic/warning lights, sign modules and the like. Although the preferred embodiments of the invention are discussed in relation to LED devices, it should be understood that the present invention can be applied to other lighting technologies, such as incandescent, plasma, liquid crystal display or the like. In one embodiment of the invention, a lighting controller for LED products includes an analog control LED dimming circuit with an analog multiplexer to obtain improved dimming and color mixing capability.

BACKGROUND OF THE INVENTION

LEDs are current-controlled devices in the sense that the intensity of the light emitted from an LED is related to the amount of current driven through the LED. FIG. 1 shows a typical relationship of relative luminosity to forward current in an LED. The longevity or useful life of LEDs is specified in terms of acceptable long-term light output degradation. Light output degradation of LEDs is primarily a function of current density over the elapsed on-time period. LEDs driven at higher levels of forward current will degrade faster, and therefore have a shorter useful life, than the same LEDs driven at lower levels of forward current. It therefore is advantageous in LED lighting systems to carefully and reliably control the amount of current through the LEDs in order to achieve the desired illumination intensity while also maximizing the life of the LEDs.

LED illumination products have been developed which provide the ability to vary the forward current through the LEDs over an acceptable range in order to provide dimming capability. LED lighting systems have also been devised which, through the use of multiple colors of LEDs and individual intensity control of each color, can produce a variety of color hues. Systems incorporating Red, Green, and Blue LEDs can achieve near infinite color variations by varying the intensity of the Red, Green, and Blue color banks.

As LED Lighting Systems have become more prevalent, various methods have been devised to control the current driven through the LEDs to achieve dimming and color mixing. One common method is a Pulse Width Modulation (PWM) scheme such as that set forth in U.S. Pat. Nos. 6,618,031, 6,510,995, 6,150,774, 6,016,038, 5,008,595, and 4,870,325, all of which are incorporated herein by reference as if set forth in full. PWM schemes pulse the LEDs alternately to a full current "ON" state followed by a zero current "OFF" state. The ratio of the ON time to total cycle time, defined as the Duty Cycle, in a fixed cycle frequency determines the time-average luminous intensity. Varying the Duty Cycle from 0% to 100% correspondingly varies the intensity of the LED as perceived by the human eye from 0% to 100% as the human eye integrates the ON/OFF pulses into a time-average luminous intensity.

Although PWM schemes are common, there are several disadvantages to this method of LED intensity control. The fixed frequency nature of PWM means that all LEDs switch on (to maximum power draw) and off (zero power draw) at the same time. Large illumination systems can easily require several amperes of current to be instantaneously switched on and off. This can create two problems. First, the rapid on and off switching of the system can create asymmetric power supply loading. Second, the pulsing of the current through electrical leads can create difficult to manage electromagnetic interference (EMI) problems because such leads may act as transmitters of radiofrequency energy that may interfere with other devices operating at similar frequencies.

In order to address these problems with PWM, an alternate method of LED intensity control, called Frequency Modulation (FM) has been developed and implemented by Artistic Licence Ltd. and described at their website, particularly in Application Note 008, located at http://www.artisticlicence.com/ (last visited Jun. 17, 2004).

The FM method of LED intensity control is similar to the PWM method in that the LEDs are switched alternately from a maximum current state to a zero current state at a rate fast enough for the human eye to see one integrated time-average intensity. The two methods differ in that PWM uses a fixed frequency and a variable pulse width (duty cycle), whereas FM delivers a fixed width pulse over a variable frequency. Both of these methods achieve a dimming effect through the varying ratio of LED ON time to OFF time. Where the FM method improves upon the PWM method, is in the fact that a varying frequency creates fewer EMI problems, and reduces the asymmetric power supply loading effect.

The FM method, however, suffers from the same drawbacks of the PWM method when the dimming level is held constant, or is changing at a relatively slow rate. In fact, at a constant level of dimming, it can be seen that the EMI and asymmetric power supply loading effects of PWM and FM are identical. As the size of the lighting system (total number of LEDs) controlled by a central control and power supply gets large, these negative effects can get correspondingly large and difficult to overcome.

There is a third prior art method of LED intensity control that eliminates the drawbacks of the PWM and FM techniques, called Analog Control. Analog Control is a method of varying the current being driven through the LEDs through a continuous analog range from zero through the maximum desired level. Since the LEDs are not constantly pulsed between two states of zero and maximum current, EMI problems are minimized, as are power supply loading problems associated with large instantaneous changes in power draw.

The Analog Control method, although solving the problems associated with PWM and FM techniques for LED driving, nevertheless has other drawbacks. Due to process variations and tolerances of analog components, including the LEDs themselves, variations in luminous intensity from the desired intensity, i.e., brightness control inaccuracies, can show up at lower levels of current where component tolerances make up a larger percentage of the total effect. In addition, wavelength shifts can occur especially at lower current levels, which can lead to undesired color shifts in the light output by the LEDs. As lighting designers seek to employ very low levels of output illumination, a higher degree of control in this range becomes more and more desirable.

It is desirable then, to devise a circuit for variably controlling the current through LEDs without the drawbacks inherent in PWM and FM schemes, and that overcomes the problems with the Analog Control circuit associated with low current levels that are described above. The invention described herein solves these problems effectively while remaining simple and inexpensive to implement.

BRIEF DESCRIPTION OF THE DRAWINGS

FIG. 1 is a graph showing a typical relationship of relative luminosity to forward current in an LED.

FIG. 2 is a diagram of the pertinent part of a prior art analog control LED dimming circuit.

FIG. 3 is a graph showing a typical relationship of the dominant wavelength shift to current in blue, cyan and green LEDs.

FIG. 4 is a diagram of the pertinent part of one embodiment of the presently inventive modulated analog control LED dimming circuit.

FIG. 5 is a table of values characterizing one example of the embodiment shown in FIG. 4.

SUMMARY OF THE INVENTION

Figure 6:
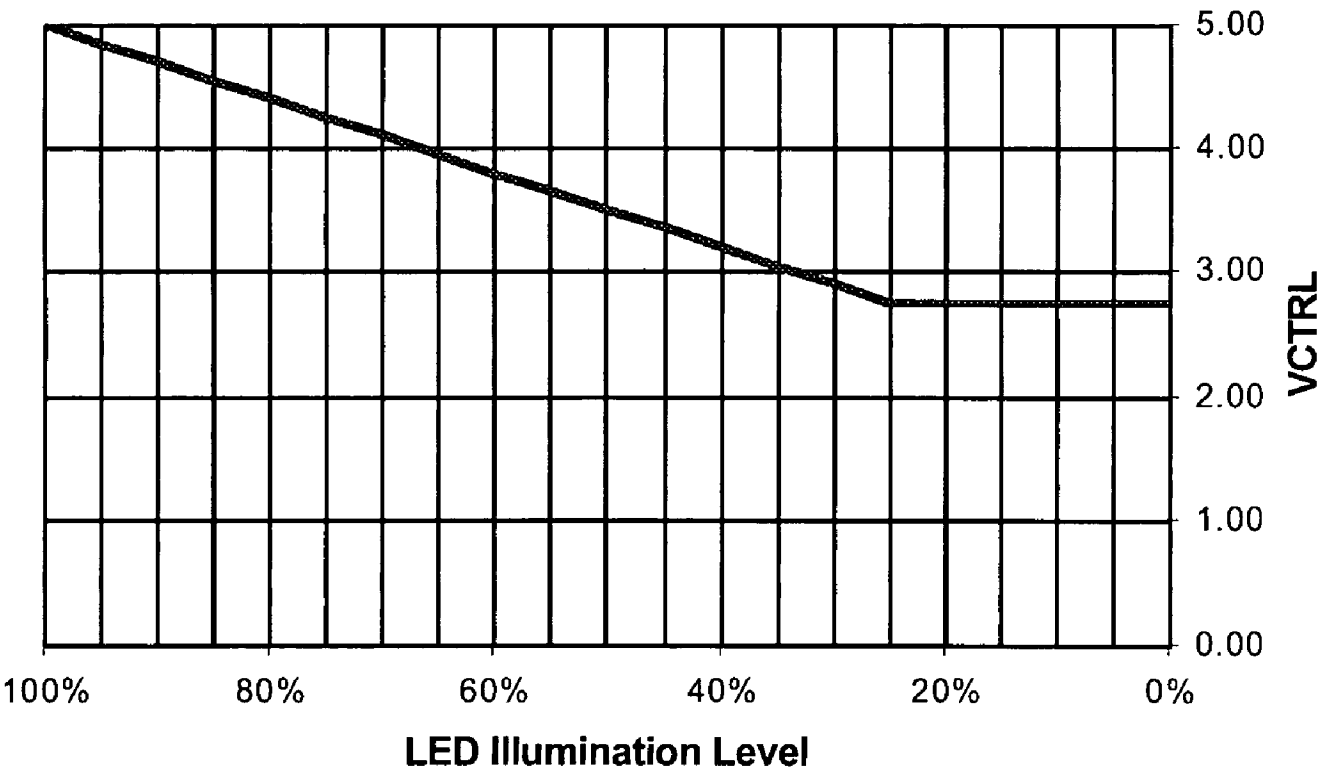
FIG. 6 is a graph showing the relationship of the values for VCTRL output and LED illumination from FIG. 5.

The present invention is directed to a lighting controller for LED products, particularly those that employ dimming and color changing effects. An advantage of the present invention is that it enhances control of an analog current limiting circuit when it is operated at low current levels. The present invention provides greater control over illumination intensity and hue for LED lighting systems by reducing differences in illumination intensity among LEDs in separate control strings and also minimizing color shifts at low levels of output illumination. The present invention also reduces the difficulties relating to EMI and asymmetric power supply loading effects found in PWM and FM control methods. Further advantages of the invention will become apparent to those of ordinary skill in the art through the disclosure herein. The advantages of the present invention can be obtained by using a modulated analog control LED dimming circuit with only a minimal addition of components or control signals.

One aspect of the invention relates to a method for controlling the intensity of an illumination source, such as an LED, by providing an input signal to a circuit containing the illumination source, and varying the input signal over a first range of illumination intensities so that the intensity of the illumination source varies in proportion to the voltage of the input signal; and varying the input signal over a second range of illumination intensities of said illumination source such that the intensity of said illumination source varies in proportion to the voltage of the input signal and the input signal is pulsed between any two or more discrete voltage levels.

Another aspect of the invention relates to an illumination control circuit comprising: a controlling module having one or more analog output signals producing output control voltages each individually variable within a range of values; one or more intensity modules receiving said analog output signals of said controlling module to control one or more illumination sources; wherein said intensity modules are controlled according to said analog output signals of said controlling module to vary the intensity of said illumination sources in proportion to the voltage level of said analog output signals, and additionally in response to a pulsing of said analog output signals between any two or more discrete voltage levels.

The advantages of the present invention can be obtained using a microcontroller having an input/output port and one or more output signals; said output signals of said microcontroller each having a first state and a second state; one or more digital-to-analog converters each having as an input the input/output port from said microcontroller, and each having an output signal; one or more switching devices each having as a first input the output signal from one of said digital-to-analog converters and each having as a second input one of said output signals from said microcontroller, and each having an analog output signal; wherein each of said analog output signals from each of said switching devices is controlled according to the output signal from one of said digital-to-analog converters when the corresponding output signal of said microcontroller is in its first state, and each of said analog output signals is connected to ground when the corresponding output signal of said microcontroller is in its second state.

Another aspect of the invention relates to an illumination control circuit comprising, for example: a microcontroller adapted to write an output control signal to a digital-to-analog converter according to programmed instructions; said digital-to-analog converter having an analog output signal that varies according to said output control signal of said microcontroller; a switching device receiving said analog output signal of said digital-to-analog converter to control an illumination source; wherein said switching device is controlled according to said analog output signal of said digital-to-analog converter to vary the intensity of said illumination source over a first range of illumination intensities of said illumination source such that the intensity of the illumination source varies in proportion to the voltage of said analog output signal of said digital-to-analog converter, and a second range of illumination intensities of said illumination source such that the intensity of said illumination source varies in proportion to the voltage of said analog output signal of said digital-to-analog converter and said analog output signal of said digital-to-analog converter is pulsed between any two or more discrete voltage levels.

DETAILED DESCRIPTION OF THE INVENTION

The present invention is best understood in relation to the prior art Analog Control circuit. FIG. 2 shows a prior art analog control LED dimming circuit. Switching devices, such as metal oxide semiconductor field effect transistors (MOSFETs) M1 and M2 along with source resistors RS1 and RS2 provide the current limiting function for their respective series strings of LEDs D11, D12, D13, D14 and D21, D22, D23, D24, respectively. That is, MOSFETs M1 and M2 and resistors RS1 and RS2, respectively, vary the current output to the LEDs in accordance with the voltage level of the signal input into the MOSFETs. Input/output port of microcontroller 10 is coupled to a digital analog converter 20 which provides the analog control voltage VCTRL to MOSFETs M1 and M2. Concentrating on the first current limiting circuit, it can be seen that with the DAC output at Ground potential (VCTRL=0V), the Gate-to-Source voltage (VGS1) of MOSFET M1 will be 0V, and the MOSFET will be off. Thus, no current will flow through the LEDs. As VCTRL increases, VGS1 increases until the Turn-On threshold (VTH1) of M1 is reached. At this point, M1 will begin sourcing current ID1 through its string of LEDs D11, D12, D13, D14. As the current ID1 flows through the source resistor RS1, a voltage potential VRS1 is created which correspondingly reduces the Gate-to-Source potential VGS1 of M1.

It can be shown, according to Ohm's Law, that as long as the control voltage VCTRL is greater than the Turn-on threshold (VTH1) of the MOSFET M1, then the current through the LEDs ID1 will follow the linear relationship: ID1=(VCTRL−VTH1)/RS1. Likewise, ID2=(VCTRL−VTH2)/RS2.

The drawback to this control circuit comes when considering component tolerances between separate control strings. Using this same example, it can be seen that VCTRL is common between the two current limiting circuits, and therefore does not contribute to any difference error between them. However, differences between RS1 and RS2 will directly contribute to differences between ID1 and ID2 and the resulting illumination levels of the LEDs. A 10% difference between these source resistors results in a 10% difference in the LED current between the two strings. Choosing tighter tolerance resistors such as 1% can easily minimize this affect.

A more difficult problem arises when considering differences between the Turn-on thresholds VTH1 and VTH2 of the MOSFETs M1 and M2. Careful examination of the equations above reveals that as VCTRL approaches the VTH threshold, a small difference between VTH1 and VTH2 makes an increasingly greater difference between ID1 and ID2. Therefore, at very low levels of output illumination, noticeable differences in intensity between LEDs in separate control strings can appear.

As an example, consider the following values for the circuit of FIG. 2:

VTH1=2.0V

VTH2=2.1V

RS1=RS2=150 Ω

VCTRL=2.0V−5.0V

The percentage difference in Turn-on Thresholds=100% (VTH2−VTH1)/VTH1=5%.

At VCTRL=5.0V:

ID1=(5.0V−2.0V)/150 Ω=20.0 mA

ID2=(5.0V−2.1V)/150 Ω=19.3 mA

The percentage difference in LED current=100% (ID2−ID1)/ID1=3.5%

Now, at VCTRL=2.2V:

ID1=1.3 mA

ID2=667 uA

The percentage difference in LED current=100% (ID2−ID1)/ID1=50%

A further difficulty with the prior art Analog Control circuit arises from the dominant wavelength shift that occurs in LEDs as the current through the LED is varied. FIG. 3 shows a graph of a typical relationship between the dominant wavelength shift to current in Blue, Green and Cyan LEDs. The graph shows that the shift is non-linear, and increases at a higher rate at low current levels. Thus, especially at lower current levels near VTH1, the color of light emitted by the LED can change as the analog circuit changes the luminous intensity.

Therefore, both of the problems inherent in the Analog Control method, intensity control and color control, are more pronounced at low LED current levels.

The present invention is an improvement on the basic Analog Control circuit for LED current limiting discussed above. This new LED current limiting circuitry greatly reduces the negative effects of Analog Control at low current levels.

FIG. 4 shows one embodiment of the present invention. Although this embodiment is used for the purpose of explaining the inventive circuit and method, one of ordinary skill in the art will readily recognize that other embodiments of this invention can be designed, without exceeding the scope of the invention, or the claims which follow.

Referring to FIG. 4, an additional switching device, which may, for example, be in the form of a 2 to 1 analog multiplexer 300, has been added between the analog control voltage output VCTRL of the DAC 200, and the MOSFETs M10 and M20 of the basic Analog Control circuit that was described in more detail FIG. 2. Together, microcontroller 100, DAC 200 and multiplexer 300 comprise a controlling module that outputs analog signals to intensity modules described below. In addition, although the present embodiment of the invention is described with one DAC, one skilled in the art will appreciate that multiple DACs could be connected to the input/output port of microcontroller 100 in alternate implementations of the invention. It will also be appreciated that one or more controlling modules may be used in alternate implementations of the invention. The number of controlling modules, and DACs within each controlling module, will generally be determined by the size and complexity of the particular lighting display.

The 1X input of multiplexer 300 is connected to the VCTRL output, and the 0X input is connected to ground (GND). The output X of multiplexer 300 is connected to the gates of the MOSFETs M10 and M20. The select line A of multiplexer 300 is connected to an output pin on the microcontroller 100. The invention can be implemented with any common analog multiplexer such as a 74HC4053 from Fairchild Semiconductor.

The analog multiplexer 300 allows the analog control voltage VCTRL to be presented to M10 and M20 whenever select line A of multiplexer 300 is in the logical "1" state. When the select line A of multiplexer 300 is in the logical "0" state, the analog voltage present on input 0X (in this case GND) is presented to the gate pins of M10 and M20, respectively, which causes them to turn off. This allows the microcontroller 100 to pulse the LEDs D110, D120, D130, D140 and D210, D220, D230, D240 (which are connected to the drain pins of MOSFETs M10 and M20, respectively) alternately On and Off, where "On" and "Off" each can be any level of current drive in the full range provided by the analog circuits that include MOSFETS M10 and M20 and source resistors RS10 and RS20, connected to the source pins thereof, respectively. Each MOSFET, source resistor and associated LEDs together comprise an intensity module, which receives the analog signal output from the controlling module described above. It will be appreciated that each set of LEDs in an individual intensity module may represent different colors, such as blue, green or cyan, such that the color mixture, or hue, of a multi-color display may be controlled according to the signals output from the controlling module individually to each of the intensity modules.

The improved analog control circuit of the present invention shares the capabilities of all three of the previously described control methods while eliminating many of the drawbacks of each. That is, it is fully capable of PWM, FM, or Analog control, strictly by the action of the microcontroller 100 as dictated in the firmware instructions encoded within. In a preferred embodiment, the dimming algorithm that is programmed into the microcontroller implements an analog control scheme for higher levels of current through the LEDs where component tolerance effects are negligible, and where dominant wavelength shifting is minimal. At lower levels of current (below a predetermined minimum current threshold), the microcontroller 100 holds the analog output level VCTRL of the DAC 200 at a constant level, and begins pulsing the multiplexer 300 select line A to inject "Off time" of zero current flow through the LEDs, thereby implementing either PWM or FM control. As the "Off time" is increased in either duration or frequency, the time averaged luminous intensity output of the LEDs continues to decrease, so the LEDs continue to dim further while the instantaneous current driven through them remains at the constant preset minimum.

In one particularly preferred embodiment of the present invention, the pulsing algorithm chosen is an inverse Frequency Modulation scheme where a negative (logic level 0) pulse of constant width is injected at increasing frequency, corresponding to increasing Off-time, and therefore decreasing On-time to Off-time ratio resulting in further dimming of the LEDs.

Figure 7:
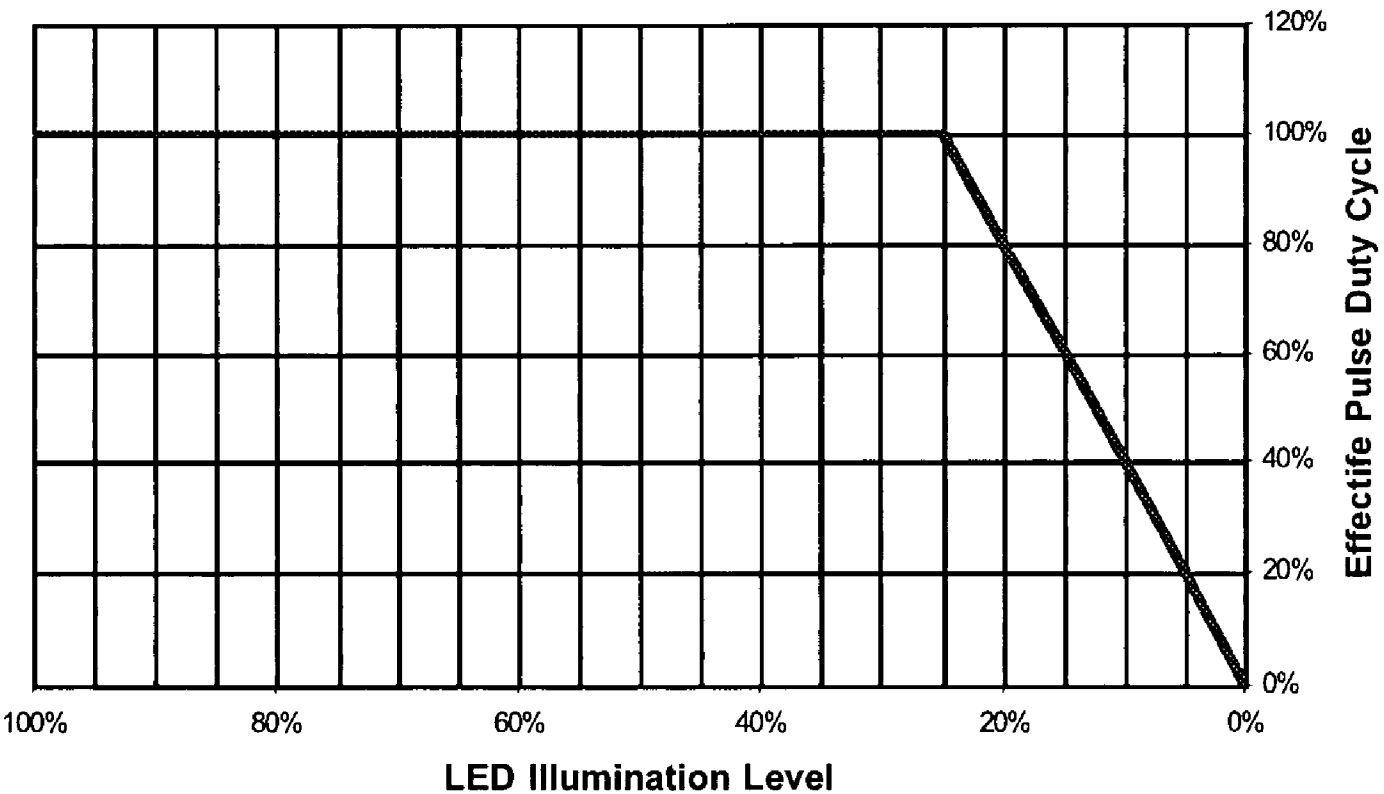
FIG. 7 is a graph showing the relationship of the values for the Effective Pulse Duty Cycle and LED illumination from FIG. 5.

FIG. 5 presents actual values characterizing the system of this one particular embodiment for VCTRL output and pulsing frequency over a full dimming range of 100% to 0% of maximum illumination level in 5% intervals where maximum illumination current through the LEDs is chosen to be 20 mA, the preset minimum current is selected as 5 mA, and Off-time pulses of 100 us duration are used. These values assume a nominal VGS turn-on threshold of 2.0V for the MOSFETs. FIGS. 6 and 7 give a graphical representation of the VCTRL output and the effective duty cycle over the full dimming range.

The values in FIGS. 5–7 are selected to clearly illustrate the principles used in the present invention. For example, in all three figures, the analog control VCTRL is shown to have a given linear slope over a first dimming range of 100% to 25%, followed by a constant value in a second dimming range of 25% to 0% of maximum illumination level. One of ordinary skill in the art will readily appreciate that the dimming range values can vary according to the design of the lighting system. For example, the first range over which VCTRL varies may be 35% to 100% of maximum illumination level or it may be 15% to 100%. Moreover, the variation in VCTRL need not be linear over this range, but can be varied non-linearly or in stepwise fashion. In addition, VCTRL need not be held constant over the second dimming, but VCTRL can also vary linearly, non-linearly or in stepwise fashion in this range as well.

Similarly, the effective pulse duty cycle need not be maintained at strictly 100% over the entire first dimming range but can be varied independently of VCTRL. For example, the effective duty cycle may be varied over a different dimming range from the range over which VCTRL is varied by varying the frequency of pulses input to select line A of multiplexer 300 over one or more dimming ranges that may or may not be the same dimming ranges over which VCTRL is varied. For example, control pulses of varying frequency or duration may be input to select line A of multiplexer 300 over a range of 35% to 0% of maximum illumination as VCTRL is being varied in one way from 100% to 20% and a second way from 20% and 0% as described above.

In addition, additional dimming ranges over which VCTRL and/or the effective pulse duty cycle may be defined. That is, VCTRL may be varied over three distinct ranges such as, for example, 100% to 35%, 35% to 20% and 20% to 0% of maximum illumination level whereas the effective pulse duty cycle may be varied over the ranges defined by 100% to 25%, 25% to 10% and 10% to 0% of the maximum illumination level.

It should also be noted that the pulsing technique chosen for this implementation is an inverse Frequency Modulation algorithm which provides the advantages over Pulse Width Modulation that were discussed above. However, because of the nature of invention (that is the low current threshold before pulsing occurs), any alternate pulsing algorithm can be used and falls within the spirit and scope of this invention in its broadest form.

Thus, as one skilled in the art will appreciate, the present invention allows for nearly any conceivable combination of variation of effective pulse duty cycle and voltage control level in any given application and therefore provides the lighting designer with maximum flexibility in designing a control scheme that maximizes objectives such as LED life, EMI and power cycle problem minimization, consistent with the needs of the particular display.

The LED dimming method of the current invention thus provides a substantial improvement over the prior art PWM, FM and Analog Control schemes in terms of design flexibility and alleviation of asymmetric loading and EMI problems.

In addition to the various embodiments of the invention discussed above, it should be noted that the invention could also be implemented without the use of the multiplexer 300 by causing the microcontroller 100 to alternately write the values to the DAC 200 representing the desired analog output of the DAC 200. For example, intermittent values "0" which will turn the MOSFETS off can be inserted into the microcontroller output signal at intervals of the desired frequency or duration to create the same VCTRL output from DAC 200 as described above in accordance with embodiments that utilize multiplexer 300. So long as there is enough processing power in terms of bandwidth available in the microcontroller 100, this "DAC pulsing" function can be performed by altering the microcontroller programming without any additional hardware over the basic Analog Control circuitry.

In addition, the present invention is implemented in, and described in terms of an LED illumination system providing dimming and/or color mixing capability. However, it will be readily appreciated by one skilled in the art that the invention provides the same benefits, and is equally applicable to LED display systems or any other illumination system using other types of illumination sources such as incandescent, plasma, liquid crystal or the like where dimming and/or color mixing are desired.

What is claimed is:

1. An illumination control circuit comprising:

a controlling module having one or more analog output signals producing output control voltages each individually variable within a range of values;

one or more intensity modules receiving said analog output signals of said controlling module to control one or more illumination sources;

wherein said intensity modules are controlled according to said analog output signals of said controlling module to vary the intensity of said illumination sources in proportion to the voltage level of said analog output signals, and additionally in response to a pulsing of said analog output signals between any two or more discrete voltage levels; and wherein said controlling module comprises:

a microcontroller having an input/output port and one or more output signals;

said output signals of said microcontroller each having a first state and a second state;

one or more digital-to-analog converters each having as an input the input/output port from said microcontroller, and each having an output signal;

one or more switching devices each having as a first input the output signal from one of said digital-to-analog converters and each having as a second input one of said output signals from said microcontroller, and each having an analog output signal;

wherein each of said analog output signals from each of said switching devices is controlled according to the output signal from one of said digital-to-analog converters when the corresponding output signal of said microcontroller is in its first state, and each of said analog output signals is connected to ground when the corresponding output signal of said microcontroller is in its second state.

2. The illumination control circuit of claim 1 wherein said output signals of said controlling module jointly vary the intensity of said illumination sources in order to achieve a dimming effect.

3. The illumination control circuit of claim 1 wherein said output signals of said controlling module individually vary the intensities of multiply colored illumination sources in order to vary the hue of the combined output of light.

4. The illumination control circuit of claim 1, wherein each switching device is an analog multiplexer.

5. The illumination control circuit of claim 1, wherein the analog output signals of said controlling module are frequency modulated.

6. The illumination control circuit of claim 1, wherein the analog output signals of said controlling module are pulse width modulated.

7. The illumination control circuit of claim 1, wherein the illumination sources comprise light emitting diodes.

8. An illumination control circuit comprising:

a microcontroller adapted to write an output control signal to a digital-to-analog converter according to programmed instructions;

said digital-to-analog converter having an analog output signal that varies according to said output control signal of said microcontroller;

a switching device receiving said analog output signal of said digital-to-analog converter to control an illumination source;

wherein said switching device is controlled according to the analog output signal of said digital-to-analog converter to vary the intensity of said illumination source over a first range of illumination intensities of said illumination source such that the intensity of the illumination source varies in proportion to the voltage of said analog output signal of said digital-to-analog converter, and a second range of illumination intensities of said illumination source such that the intensity of said illumination source varies in proportion to the voltage of the analog output signal of said digital-to-analog converter and said analog output signal of said digital-to-analog converter is pulsed between any two or more discrete voltage levels.

9. An illumination control circuit comprising:

a controlling module having one or more analog output signals producing output control voltages each individually variable within a range of values;

one or more intensity modules receiving said analog output signals of said controlling module to control one or more illumination sources;

wherein said intensity modules are controlled according to said analog output signals of said controlling module to vary the intensity of said illumination sources in proportion to the voltage level of said analog output signals, and additionally in response to a pulsing of said analog output signals between any two or more discrete voltage levels; and wherein each intensity module includes a voltage-to-current converter having as its input one of said analog output signals from said controlling module, and each having an output connected to one or more of said illumination sources providing a current to said illumination sources proportional to the voltage level of said analog output signal.

10. The illumination control circuit of claim 9 wherein each voltage-to-current converter is a MOSFET with a resistor connected between the source pin of said MOSFET and ground, the input of said voltage-to-current converter is the gate pin of said MOSFET, and the output of said voltage-to-current converter is the drain pin of said MOSFET.

* * * * *